United States Patent [19]

Upton

[11] Patent Number: 4,941,202

[45] Date of Patent: Jul. 10, 1990

[54] MULTIPLE SEGMENT FLEXTENSIONAL TRANSDUCER SHELL

[75] Inventor: Ralph G. Upton, Nashua, N.H.

[73] Assignee: Sanders Associates, Inc., Nashua, N.H.

[21] Appl. No.: 416,793

[22] Filed: Sep. 13, 1982

[51] Int. Cl.[5] ..... H04R 17/00

[52] U.S. Cl. ..... 367/165; 367/158; 310/337

[58] Field of Search ..... 367/155, 188, 157, 158, 367/153, 159, 160, 162, 165, 176; 310/322, 324, 334, 337

[56] References Cited

U.S. PATENT DOCUMENTS

| | | | |
|---|---|---|---|
| 2,301,269 | 11/1942 | Gerber | 310/355 |
| 2,425,594 | 8/1947 | Brown | 367/163 |
| 2,795,709 | 6/1957 | Camp | 367/157 |
| 2,834,000 | 5/1958 | Wiggins | 367/173 |
| 2,895,062 | 7/1959 | Abbott | 310/334 |
| 2,928,069 | 3/1960 | Petermann | 367/157 |
| 2,930,912 | 3/1960 | Miller | 367/157 |
| 3,043,967 | 7/1962 | Clearwaters | 367/153 X |
| 3,139,603 | 6/1964 | Church et al. | 367/155 |
| 3,177,382 | 4/1965 | Green | 367/157 |
| 3,199,071 | 8/1965 | Massa | 367/158 |
| 3,215,977 | 11/1965 | Williams et al. | 310/334 X |
| 3,222,462 | 9/1962 | Karmann et al. | 179/110 F |
| 3,230,505 | 1/1966 | Parker et al. | 367/141 |
| 3,241,099 | 3/1966 | Elston et al. | 367/167 |
| 3,243,767 | 3/1966 | Kendig et al. | 367/155 |
| 3,258,738 | 6/1966 | Merchant | 367/155 |
| 3,274,537 | 9/1966 | Toulis | 367/155 |
| 3,277,433 | 10/1966 | Toulis | 367/155 |
| 3,325,780 | 6/1967 | Horan | 367/164 |
| 3,370,187 | 2/1968 | Straube | 367/161 |
| 3,444,508 | 5/1969 | Granfors et al. | 367/157 |
| 3,497,729 | 2/1970 | Mueller | 310/338 |
| 3,543,059 | 11/1970 | Angeloff | 367/157 X |
| 3,564,491 | 2/1971 | Granfors et al. | 367/157 |
| 3,706,967 | 12/1972 | Renna, Jr. | 367/159 |
| 3,749,948 | 7/1973 | Morris | 310/326 |
| 3,778,758 | 12/1973 | Carson | 367/158 X |
| 3,805,226 | 4/1974 | Holloway | 367/166 X |
| 3,813,744 | 6/1974 | Morris | 29/25.35 |
| 3,832,762 | 9/1974 | Johnston et al. | 29/25.35 |
| 3,846,744 | 11/1974 | Renna, Jr. et al. | 367/159 |
| 3,982,144 | 9/1976 | Rogers et al. | 367/157 |
| 3,992,693 | 11/1976 | Martin et al. | 367/155 |
| 4,015,233 | 3/1977 | Laurent et al. | 367/165 |
| 4,191,904 | 3/1980 | Massa | 310/322 |
| 4,220,887 | 9/1980 | Kompanek | 310/334 |
| 4,228,532 | 10/1980 | Sims | 310/337 X |
| 4,236,235 | 11/1980 | Gilbert | 367/157 |
| 4,384,351 | 5/1983 | Pagliarini, Jr. et al. | 367/175 |
| 4,420,826 | 12/1983 | Marshall, Jr. et al. | 367/155 X |
| 4,432,080 | 2/1984 | Wardle | 310/337 X |
| 4,435,794 | 3/1984 | Marshall, Jr. et al. | 367/155 |
| 4,446,544 | 5/1984 | Connolly, Jr. | 367/162 X |
| 4,462,093 | 7/1984 | Upton | 367/165 |

OTHER PUBLICATIONS

Larry Royster, *The Flextensional Concept,* Applied Acoustics (3), 1970, Elsevier Publishing, England, pp. 117–126.

Morse, P. M., *Vibration and Sound,* Second Edition, (McGraw-Hill, New York, 1948), pp. 83, 84 and 140.

Lamb, H., *The Dynamical Theory of Sound,* Second Edition, (Dover Publications, New York, 1960), p. 129.

*Primary Examiner*—Brian S. Steinberger

*Attorney, Agent, or Firm*—Stanton D. Weinstein; Ronald Reichman

[57] ABSTRACT

This invention is a multiple segment flextensional transducer shell that is easily and quickly manufactured and modified. The shell may comprise two adjustable, flexible plates and two buttress bars or two J-shaped adjustable, flexible plates. When the buttress bars and plates or the J-shaped members are connected together at or near the nodal points of the transducer, the assembled shell will have the same shape as the flextensional transducer shells used in the prior art. The open ends of the assembled transducer shell are covered with flanges and a boot is placed over the shell and flanges to make the interior of the shell air tight.

49 Claims, 4 Drawing Sheets

MULTIPLE SEGMENT FLEXTENSIONAL TRANSDUCER SHELL

FIELD OF THE INVENTION

This invention relates to underwater communications systems and, more particularly, to flextensional transducers that have shells which have a multiplicity of segments which are used to detect objects under water.

BACKGROUND OF THE INVENTION

One type of transducer utilized by the prior art was a flextensional transducer. Flextensional transducers have wider bandwidths, lower operating frequencies and higher power handling capabilities than other types of transducers of comparable size. Flextensional transducers have a single piece, flexible, outer elliptically-shaped shell or housing which is excited by one or more driving elements. The driving elements may be electromagnetic drives, magnetostrictive drives or one or more piezoelectric ceramic stacks. Piezoelectric stacks are driven in a length expander mode and are placed in compression between opposing interior walls of the shell. The elongation and contraction of the piezoelectric stacks imparts a motion to the shell which, in general, radiates or couples energy into the water.

Flextensional transducers are designed to emit sound pressure waves at particular frequencies and power levels. The resonant frequency of the transducer is determined by some characteristics of the shell, namely: the thickness of the shell wall, the length and curvature of the arc of the shell and the ratio between the major and minor axis of the shell. Thus, if the transducer is not resonating at its design frequency, the shape of the shell must be modified.

Single piece shells are expensive and time consuming to manufacture and/or modify because each shell is manufactured and/or modified one at a time by costly manufacturing procedures. The single piece shell was machined from a solid material such as an aluminum or steel alloy or a fiberglass or graphite filament that was fabricated on a mandrel. The above shells could only be modified slightly, since one would be able to thin the wall of the shell, but would not be able to change the length and curvature of the arc of the shell or the ratio between the shell's major and minor axis. It was also difficult to adjust the prestress that was applied to the piezoelectric stacks. The piezoelectric stacks were usually prestressed by placing the transducer shell in a hydraulic press and squeezing the shell across its minor axis while the stacks were placed between the inner major axis walls of the transducer.

SUMMARY OF THE INVENTION

This invention overcomes the disadvantages of the prior art by creating a multiple segment, inexpensive, flextensional transducer shell that is easily and quickly manufactured and modified. The shell may be comprised of two plates and two buttress bars that are manufactured from a metal alloy. When the plates and buttress bars are connected together at or near the nodal points of the transducer, with magnetostrictive drives, electromagnetic drives or piezoelectric stacks interposed between the buttress bars, the assembled shell will have the same shape as the flextensional transducers used in the prior art. When the transducer is submerged in water and vibrating near its operating frequency, there will be four nodal points or positions around the circumference of the shell that are essentially motionless.

The dimensions and curvature of the plates and buttress bars are appropriately defined so that the desired major to minor axis ratio of the shell will be determined when the buttress bars are forced against the piezoelectric stacks and connected to the plates. The plates and buttress bars may be manufactured by many different inexpensive processes, i.e. casting, rolling, etc. In the event the fabricated or assembled shell does not resonate at the design frequency of the transducer, then the shape of the shell may be modified in a short period of time by bending the plates and/or machining the buttress bars. The changes in the transducer's plates and/or buttress bars will change the ratio of the major to minor axis of the transducer as well as change the length and curvature of the arc of the shell. The thickness of the walls of the shell may also be changed by milling one or more plates and/or buttress bars. Thus, by utilizing the apparatus of this invention, it is usually possible to design and fabricate a flextensional transducer with one prototype model. The apparatus of this invention may also be used to mass produce flextensional transducers.

The multiple segment shell concept also permits the piezoelectric stacks to be prestressed to varying degrees of stress during the assembly of the shell. Different amounts of prestress may be applied to the piezoelectric stacks by tightening or loosening the bolts that connect the buttress bars to the plates. Shims may also be attached to or removed from the buttress bars to increase or decrease the amount of prestress on the ceramic stacks. Thus, the apparatus of this invention supplies a convenient method for adjusting the prestress on the piezoelectric ceramic stacks.

It is an object of this invention to provide a new and improved multiple piece flextensional transducer shell.

Other objects and advantages of this invention will become more apparent as the following description proceeds, which invention should be considered together with the accompanying drawings.

BRIEF DESCRIPTION OF THE DRAWINGS

FIG. 6 is a cross-sectional view of an embodiment of a four segment flextensional transducer.

DESCRIPTION OF A PREFERRED EMBODIMENT

Figure 1:
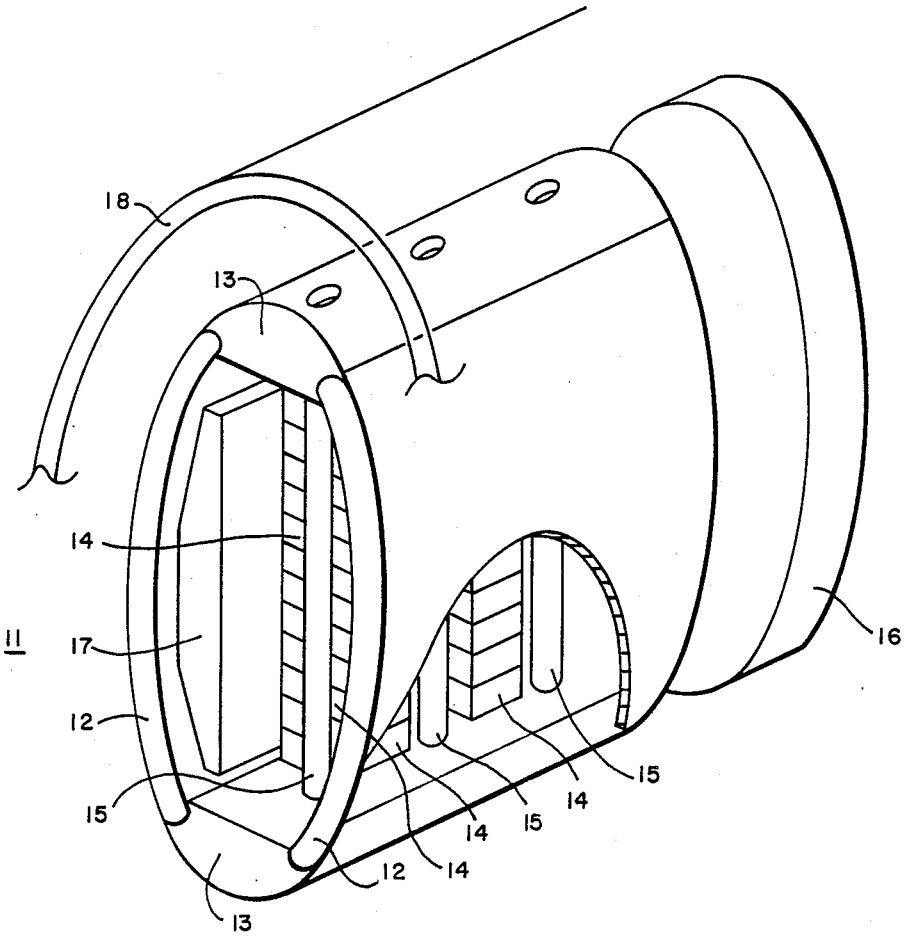
FIG. 1 is a perspective representation, partially in section, showing a four segment flextensional transducer.

Referring now to the drawings in detail, and more particularly to FIG. 1, the reference character 11 represents a multiple segment flextensional transducer. The shell of transducer 11 comprises flexural plates 12 and buttress bars 13. The dimensions and curvature of plates 12 and buttress bars 13 are dependent upon the desired resonant frequency of transducer 11. Generally, the resonant frequency of transducer 11 may be increased by increasing the thickness of plates 12. The dimensions of plates 12 and bars 13 are set so that when plates 12 and bars 13 are assembled to form the shell of transducer 11, the intersection of plates 12 and bars 13 will be at or near the four nodal points of transducer 11.

Transducer 11 is assembled by placing the end of plates 12 in the cut out regions of bars 13 (regions of bars 13 are cut out so that there will be a smooth and tight fit between plates 12 and bars 13). Piezoelectric stacks 14 are positioned on bars 13, and tie bolts 15 are inserted and bolted to bars 13. Additional prestress may be applied to stacks 14 by tightening bolts 15 and/or inserting shims (not shown) between bars 13 and stacks 14. The driving elements may be electromagnetic drives, magnetostrictive drives or one or more piezoelectric ceramic stacks. The open ends of transducer 11 are partially closed by flanges 16 (only one flange is shown). Flanges 16 are held in place by tie rods 17 (only one tie rod is shown). Boot 18 is now placed over flanges 16, plates 12 and bars 13 to insure that transducer 11 will be air tight.

Figure 2:
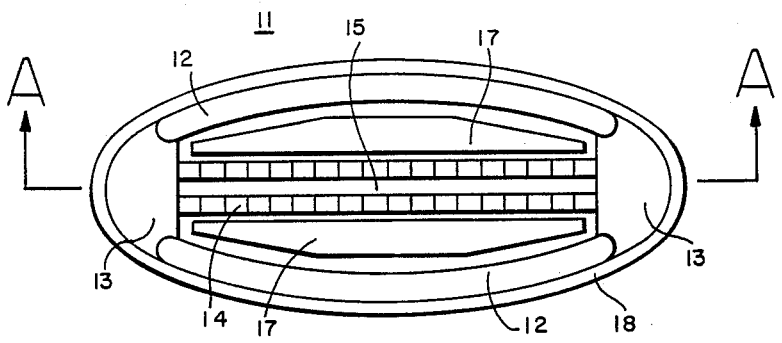
FIG. 2 is an end view of a four segment flextensional transducer.

FIG. 2 is an end view of the transducer depicted in FIG. 1. Plates 12, bars 13 and rods 15 hold piezoelectric stacks 14 against bars 13. Tie rods 17 are connected to flanges 16 (not shown) and boot 18 is placed around transducer 11. In the event that the assembled transducer 11 does not resonate at its designed frequency, transducer 11 may be easily disassembled and the curvature and dimensions of the plates 12 and bars 13 adjusted. Transducer 11 may now be reassembled and tested to determine if transducer 11 resonates at its designed frequency. The foregoing testing and reassembly procedure would continue until the resonant frequency of transducer 11 equaled its design frequency.

Figure 3:
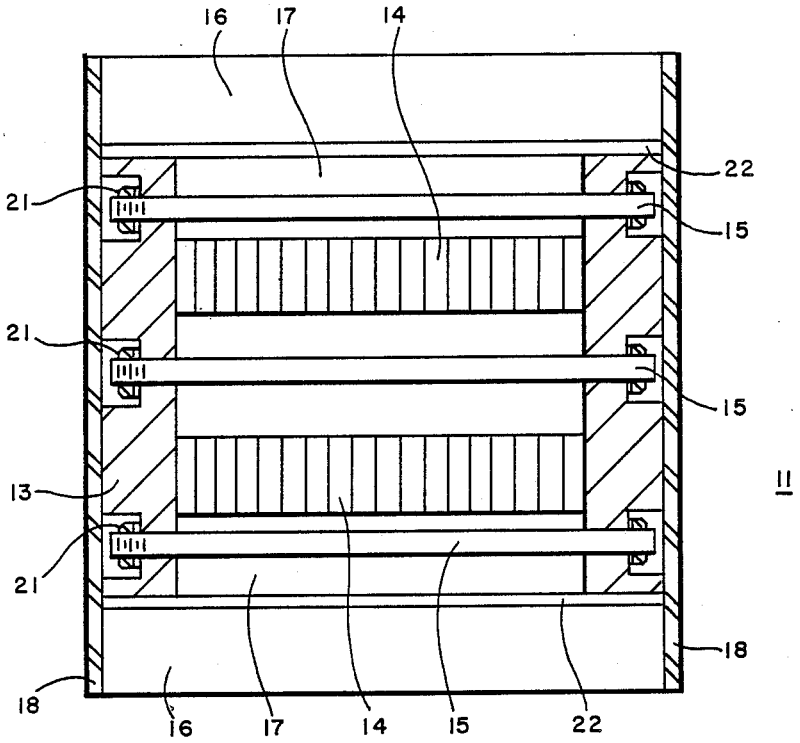
FIG. 3 is a cross-sectional view of the transducer depicted in FIG. 2 along axis A—A.

FIG. 3 is a cross-sectional view of the transducer depicted in FIG. 2 along axis A—A. Piezoelectric stacks 14 are held against buttress bars 13 by tie bolts 15. The nut 21 may be tightened, varying the amount of stress applied to stacks 14. In order to create air gaps 22 between the shell of transducer 11 and flanges 16, the open ends of the transducer's shell are partially closed by flanges 16. Tie rods 17 are connected to flanges 16, and rods 17 hold flanges 16 apart to preserve air gaps 22.

Gaps 22 ensure that the stacks 14 and the shell of transducer 11 are not directly coupled to flanges 16 thereby limiting the acoustic output of transducer 11 by damping the motion of its shell.

Figure 4:
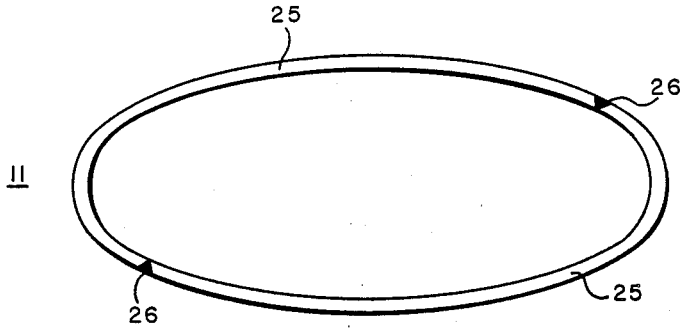
FIG. 4 is a representation of a flextensional transducer shell that is formed from two J-shaped plates that are welded together.

FIG. 4 illustrates an embodiment similar to that of FIGS. 1–3 except that the walls of transducer 11 are formed from two J-shaped, flexible, metal plates 25 that are welded together at or near two nodal points on the shell of transducer 11. Welds 26 are full thickness welds that are ground flush on both sides of the transducer wall.

Figure 5:
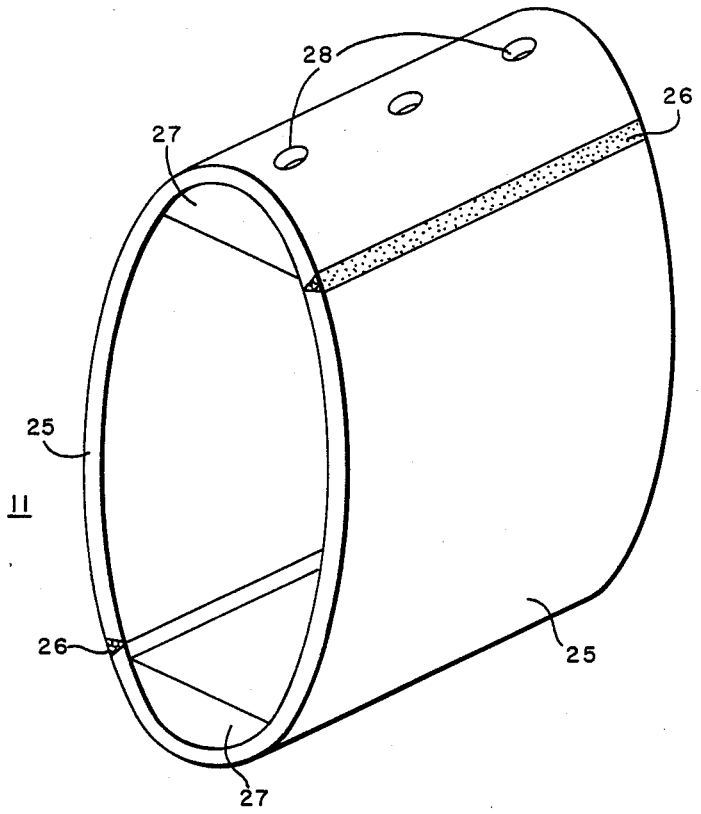
FIG. 5 is a perspective representation of the transducer shell shown in FIG. 4 with the addition of two insert members.

FIG. 5 illustrates an embodiment similar to FIG. 4 except insert members 27 are glued to plates 27 or bolted to plates 27 by bolts 28. Insert members 27 are utilized in those instances where large and/or heavy piezoelectric stacks (not shown) are used and plate 27 must be more rigid in order to support the piezoelectric stacks. The other elements illustrated in FIGS. 1–3 may be included in FIGS. 4 and 5 in the same manner heretofore described. FIG. 6 is a cross-sectional view of an embodiment of the transducer showing shims 29 inserted between bars 13 and stacks 14.

The above specification describes a new and improved flextensional transducer shell. It is realized that the above description may indicate to those skilled in the art additional ways in which the principles of this invention may be used without departing from its spirit. It is, therefore, intended that this invention be limited only by the scope of the appended claims.

What is claimed is:

1. A flextensional transducer having a hollow shell with two open ends that are covered with a material and at least one driving element interposed between the inner walls of said shell, said transducer shell comprises:

(a) a first J-shaped metal member;

(b) a second J-shaped metal member, said first and second members are welded together, to form said smooth hollow shell, at or near two nodal points on the surface of said shell; and (c) a boot that is placed over said members and said material so that the interior of said shell will be watertight.

2. The transducer shell claimed in claim 1 further including:

(a) a first insert plate that is connected to that portion of the inner surface of said shell along one end of the major axis of said shell; and (b) a second insert plate that is connected to that portion of the inner surface of said shell along the other end of the major axis of said shell.

3. A transducer as recited in claim 1, wherein said first and second members are adjustable.

4. A transducer as recited in claim 1, wherein said first and second members are flexible.

5. A flextensional transducer having a hollow shell with two open ends that are covered with a material and at least one driving element interposed between the inner walls of said shell, said transducer shell comprising:

(a) a first metal plate;

(b) a second metal plate;

(c) a first buttress bar, the inner side of which is disposed adjacent said driving element;

(d) a second buttress bar, the inner side of which is disposed adjacent said driving element, wherein said first and second bars are connected to said first and second plates, respectively at or near two nodal points on the surface of the smooth hollow shell that is formed by the connection of said plates and said bars; and (e) a boot that is placed over said members and said material so that the interior of said shell will be watertight.

6. The transducer shell claimed in claim 5 wherein said plates and said buttress bars are connected together by the ends of said plates being held in a region of said buttress bars by one or more bolts that connect said bars.

7. A transducer as recited in claim 6, further comprising first means engaging said one or more bolts for enabling or changing the amount of prestress that is applied to said driving element.

8. The transducer claimed in claim 6 wherein said driving element comprises at least one piezoelectric stack.

9. The transducer claimed in claim 8 wherein said bolts are adjustable so that the amount of prestress that is applied to said piezoelectric stack may be varied.

10. The transducer claimed in claim 5 wherein said driving element comprises at least one piezoelectric stack.

11. The transducer claimed in claim 3 further including:

(a) a first shim disposed between said driving element and said first bar; and (b) a second shim disposed between said driving element and said second bar, said first and second shims increase the amount of prestress that is applied to said driving element.

12. A transducer as recited in claim 5, wherein said first and second plates are adjustable.

13. A transducer as recited in claim 5, wherein said first and second plates are flexible.

14. A flextensional transducer, comprising:

first and second curved plates;

first and second buttress bars, each engaging said first and second plates; and driving means disposed between said first and second bars for driving said first and second bars with respect to each other and thereby driving said first and second plates with respect to each other.

15. A transducer as recited in claim 14, wherein said first and second plates are adjustable.

16. A transducer as recited in claim 14, wherein said first and second plates are adapted to be capable of undergoing flexural vibration.

17. A transducer as recited in claim 14, further comprising cover means enclosing said first and second plates and said first and second bars for making watertight an area defined by said bars and plates.

18. A transducer as recited in claim 14, wherein:

the transducer has first and second open ends; and the transducer further comprises;

a first flange member disposed at the first open end of the transducer; and a second flange member disposed at the second open end of the transducer.

19. A flextensional transducer, comprising:

first and second curved plates; and first and second buttress bars, each engaging said first and second plates, wherein said first and second buttress bars each engage said first and second curved plates to form a shell of the transducer; and wherein said buttress bars engage said curved plates at or near respective nodal positions of said shell.

20. A transducer as recited in claim 14, further comprising stress means connected to said first and second bars for prestressing said driving means.

21. A transducer as recited in claim 14, further comprising a shim disposed between a bar and said driving means.

22. A transducer as recited in claim 14 wherein said driving means comprises a piezoelectric stack.

23. A flextensional transducer, comprising:

a plurality of members, each member engaging at least one other member of said plurality of members to form a shell and together define an open cavity of said shell, said cavity having a surface traceable by a straight line moving parallel to a fixed straight center line of said cavity, the cavity of width greater than the smallest linear dimension of a member, wherein no member of said plurality of members alone forms any open cylindrical cavity of said shell.

24. A flextensional transducer as recited in claim 23, wherein each member of said plurality is of metal and is configured to minimize any compliant acoustic degradation contributed by that said member to said shell.

25. A flextensional transducer as recited in claim 23, wherein each member of said plurality is of fiberglass or graphite and is configured to minimize any compliant acoustic degradation contributed by that said member to said shell.

26. A flextensional transducer as recited in claim 23, further comprising cover means enclosing said plurality of members for making the cavity watertight.

27. A flextensional transducer as recited in claim 23, further comprising holding means connected to some of said plurality of members for holding said plurality of members in a predetermined arrangement to form the cavity.

28. A flextensional transducer as recited in claim 27, wherein said holding means comprises a bolt connected to two non-adjacent members.

29. A flextensional transducer as recited in claim 23, further comprising driving means disposed between some of said members for driving some of said members with respect to each other.

30. A flextensional transducer as recited in claim 29, further comprising stress means connected to some of said members for adjustably prestressing said driving means.

31. A flextensional transducer as recited in claim 29, further comprising a shim disposed between a member and said driving means.

32. A flextensional transducer as recited in claim 29, wherein said driving means comprises a piezoelectric stack.

33. A flextensional transducer as recited in claim 23, wherein a member is adapted to be capable of undergoing flexural vibration.

34. A flextensional transducer as recited in claim 23, wherein each member engages at least one other member of said plurality of members at or near a nodal point of the shell.

35. A flextensional transducer as recited in claim 23, wherein said plurality of members comprises more than two members.

36. A flextensional transducer, comprising:

a shell comprising a plurality of members, each member engaging at least one other member of said plurality of members, at or near a nodal position of said shell, to form said shell and an open cavity of said shell of width greater than the smallest linear dimension of a member; and holding means disposed within the cavity, connected to some of said plurality of members, for holding said plurality of members in a predetermined arrangement, wherein no member of said plurality of members alone forms any open cylindrical cavity of said shell.

37. A flextensional transducer as recited in claim 36, wherein said holding means comprises a bolt connected to two non-adjacent members.

38. A flextensional transducer as recited in claim 36:

wherein said flextensional transducer further comprises driving means disposed between some of said members of said plurality for driving some of said members with respect to each other; and wherein said holding means comprises stress means for adjustably prestressing said driving means.

39. A flextensional transducer, comprising:

a plurality of members, each member engaging at least one other member of said plurality of members to form a shell and together define an open cavity of said shell, said cavity having a surface traceable by a straight line moving parallel to a fixed straight center line of said cavity, the cavity of width greater than the smallest linear dimension of a member, wherein engagement of each member of said plurality with an adjacent member of said plurality is substantially coplanar with the center line.

40. A flextensional transducer as recited in claim 39, wherein said plurality of members comprises more than two members.

41. A flextensional transducer as recited in claim 39, wherein each member of said plurality is of metal and is configured to minimize any compliant acoustic degradation contributed by that member to said shell.

42. A flextensional transducer as recited in claim 39, wherein each member of said plurality is of fiberglass or graphite and is configured to minimize any compliant acoustic degradation contributed by that member to said shell.

43. A flextensional transducer as recited in claim 39, further comprising holding means connected to some of said plurality of members for holding said plurality of members in a predetermined arrangement to form the cavity.

44. A flextensional transducer as recited in claim 43, wherein said holding means comprises a bolt connected to two non-adjacent members.

45. A flextensional transducer as recited in claim 39, further comprising driving means disposed between some of said members for driving some of said members with respect to each other.

46. A flextensional transducer as recited in claim 45, further comprising stress means connected to some of said members for adjustably prestressing said driving means.

47. A flextensional transducer as recited in claim 45, wherein said driving means comprises a piezoelectric stack.

48. A flextensional transducer as recited in claim 39, wherein each member engages at least one other member of said plurality of members at or near a nodal point of the shell.

49. A flextensional transducer as recited in claim 36, wherein said plurality of members comprises more than two members.

* * * * *